United States Patent [19]

Levie et al.

[11] Patent Number: 4,504,767

[45] Date of Patent: Mar. 12, 1985

[54] MAGNETRON MODE DETECTOR

[75] Inventors: Stephen A. Levie, Burnsville; William E. Taylor, Golden Valley, both of Minn.

[73] Assignee: Litton Systems, Inc., Beverly Hills, Calif.

[21] Appl. No.: 415,627

[22] Filed: Sep. 7, 1982

[51] Int. Cl.[3] ..... H05B 37/00; H05B 41/14

[52] U.S. Cl. ..... 315/101; 315/105; 217/10.55 B; 331/91; 324/412

[58] Field of Search ..... 315/39.51, 105, 101, 315/106; 331/64, 91; 333/21 A, 228; 219/10.55 B, 10.55 F; 324/412

[56] References Cited

U.S. PATENT DOCUMENTS

| | | | |
|---|---|---|---|
| 3,302,060 | 1/1967 | Blok et al. | 219/10.55 B |
| 3,752,948 | 8/1973 | Peterson | 331/91 |
| 3,784,781 | 1/1974 | Foerstner et al. | 331/91 |
| 4,318,165 | 3/1982 | Kornrumpf et al. | 219/10.55 B |
| 4,415,789 | 11/1983 | Nabue et al. | 333/228 |

FOREIGN PATENT DOCUMENTS

| | | | |
|---|---|---|---|
| 738522 | 10/1955 | United Kingdom | 331/91 |

*Primary Examiner*—Saxfield Chatmon
*Attorney, Agent, or Firm*—John M. Haurykiewicz

[57] ABSTRACT

A mode detector for microwave oven magnetrons is disclosed including means for sensing interruption of anode current and providing a discrete indication thereof. An alternative embodiment discloses means to count the number of such interruptions. A method of detecting incipient failure of the magnetron is disclosed wherein the discrete output of a mode detector is observed and a determination is made that an incipient failure exists when the mode detector output frequency exceeds a predetermined limit.

6 Claims, 4 Drawing Figures

MAGNETRON MODE DETECTOR

BACKGROUND OF THE INVENTION

An early sign of magnetron failure is its beginning to mode, that is, to abruptly cease to conduct anode current. Since the majority of magnetron power supplies are of the current limiting type each interruption of anode current results in a large voltage transient. Herefore, direct observation of this circuit phenomenon required the use of expensive and sophisticated laboratory equipment such as high frequency oscilloscopes. Because service personnel diagnosing and repairing problems in microwave ovens are customarily not trained in the use of and do not ordinarily have access to laboratory oscilloscopes while performing service on microwave ovens, direct observation of magnetron moding has been previously unavailable as a procedure in the servicing of microwave ovens.

Heretofore, the most common method of diagnosing magnetron moding in the servicing of microwave ovens has been by observing a reduction in the apparent power output of the microwave oven. However, diagnosing a "defective" magnetron by this method has proven unreliable and expensive since the symptom may be indicative of other problems than magnetron moding (as for example, low line voltage) and also has led to the premature replacement of magnetrons which have a significant remaining useful life, even though they may exhibit infrequent moding.

BRIEF SUMMARY OF THE INVENTION

The present invention overcomes the disadvantages of prior methods of diagnosing magnetron moding by providing a simple, low cost mode detector suitable for use by microwave oven service personnel without requiring special training. The mode detector of this invention incudes a voltage divider to lower the magnetron anode voltage to a level appropriate for the remaining circuitry, a trigger circuit which provides an output in response to magnetron moding, a pulse extender circuit which extends a pulse corresponding to magnetron moding, and a mode indicator which provides a discrete display of the occurrence and frequency of magnetron moding. In one embodiment the indicator comprises an LED. In a second embodiment, the indicator comprises a counter.

A further aspect of this invention comprises a method of detecting incipient failure of a magnetron in a microwave oven. The method includes connecting the mode detector apparatus to the microwave oven magnetron circuit, observing the discrete output of the mode detector and finally, determining that an incipient failure exists when the discrete output from the mode detector equals or exceeds a predetermined frequency.

DETAILED DESCRIPTION

Figure 1:
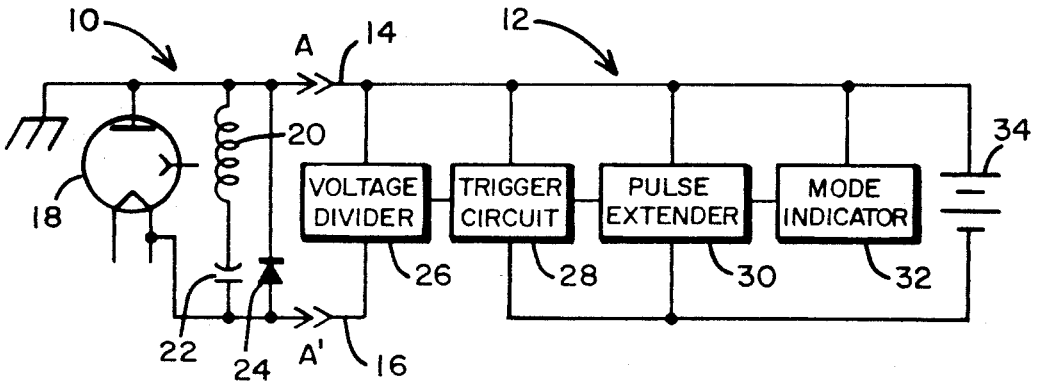
FIG. 1 shows a typical half wave magnetron power supply and a block diagram of the mode detector of this invention.

Referring to FIG. 1, a typical half wave magnetron power supply 10 is shown to which a mode detector 12 is connected through terminals A-A' which terminals are connected respectively to leads 14, 16. Power supply 10 includes magnetron 18, a high voltage transformer winding 20, a high voltage capacitor 22 and a high voltage diode 24.

Mode detector 12 has a voltage divider 26 connected by means of leads 14, 16 to the magnetron anode circuit of power supply 10. Voltage divider 26 feeds a trigger circuit 28 which is connected to a pulse extender 30 and a mode indicator 32. A battery 34, preferably 9 volts provides power to trigger circuit 28, pulse extender 30, and a mode indicator 32.

Figure 2:
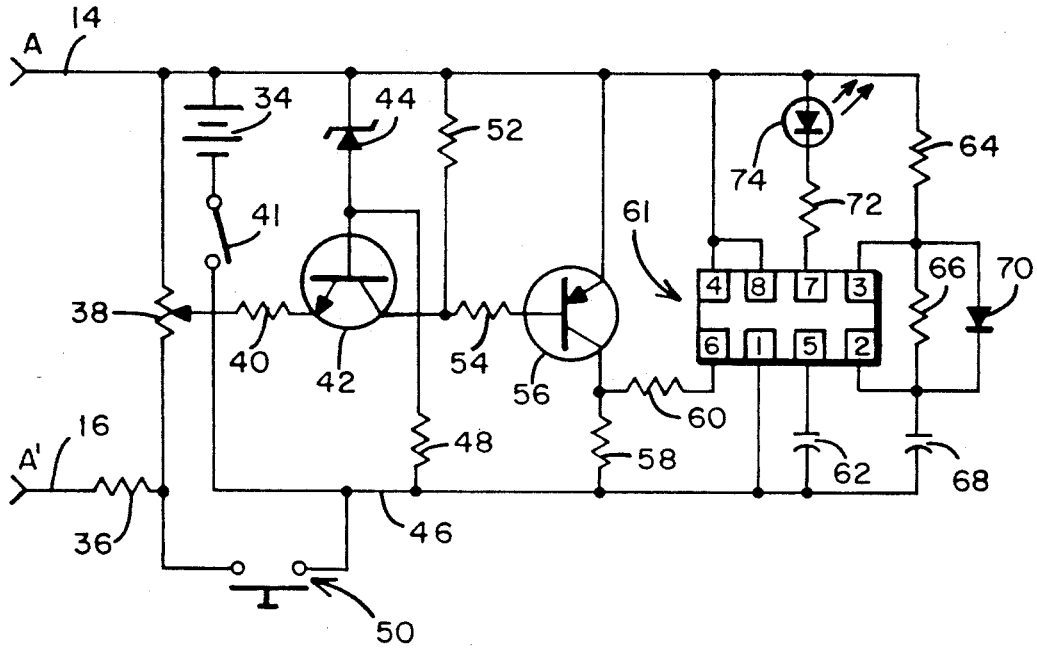
FIG. 2 shows a detailed circuit schematic of a first embodiment of the mode detector.

Referring now more particularly to FIG. 2, mode detector 12 may be seen in more detail. In this embodiment, voltage divider 26 is made up of a 6 meg ohm resistor 36 and a 10 Kohm "calibrate" potentiometer 38. The arm of potentiometer 38 is connected to trigger circuit 28 which includes a 100 ohm resistor 40 connected to the emitter of a transistor 42, preferably a 2N4461 type. The base of transistor 42 is connected to lead 14 through a 5.1 volt zener diode 44 and also to a minus logic power supply lead 46 through a 1 Kohm resistor 48. A BATTERY TEST switch 50 is provided between lead 46 and the junction of resistors 36, 38. The collector of transistor 42 is connected to lead 14 through a 10 Kohm resistor 52 and through a 10 Kohm resistor 54 to the base of a transistor 56, preferably a 2N3906 type. The emitter of transistor 56 is connected directly to lead 14 and the collector is connected through a 10 Kohm resistor 58 to lead 46 and to the input of the pulse extender circuit 30 through a 1 Kohm resistor 60.

The positive terminal of battery 34 is connected to lead 14. The negative terminal of battery 34 is connected through an ON-OFF switch 41 to lead 46.

Pulse extender circuit 30 includes a 555 type integrated circuit monostable multivibrator 61 and associated timing circuitry: a 0.01 mf capacitor 62, a 4.7 Kohm resistor 64, a 13 Kohm resistor 66, a 100 mf capacitor 68, and a diode 70, preferably a 1N914 type. The output of the pulse extender circuit 30 is connected to and drives the mode indicator 32 which, in the embodiment shown in FIG. 2, is made up of a 430 ohm resistor 72 and a light emitting diode LED 74.

Figure 3:
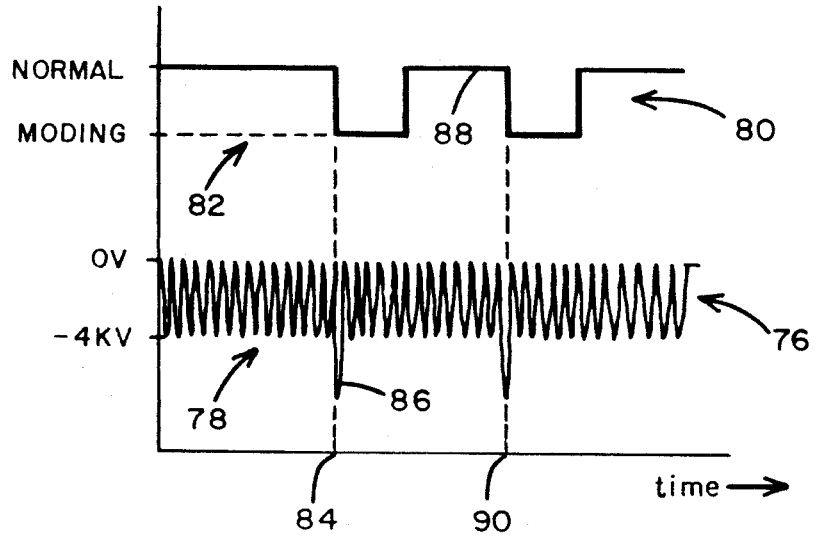
FIG. 3 shows waveforms corresponding to magnetron moding and corresponding discrete indication thereof provided by the mode detector.

Referring now more particularly to FIGS. 2 and 3, the operation of this embodiment is as follows. A typical high voltage anode waveform of a magnetron tube which exhibits intermittent moding is shown in a lower trace 76 of FIG. 3. This corresponds to the voltage appearing across leads 14, 16 with the voltage at lead 16 negative with respect to lead 14. The diode 44 and resistor 48 reverse bias the base-emitter junction of transistor 42, blocking any collector-emitter conduction. At a random point in time 84, magnetron 18 modes, or abruptly ceases conduction. A large voltage transient 86 (exceeding 6 KV) occurs at this time, and is sensed by trigger circuit 28 after being reduced to an acceptable level by voltage divider 26. The base-emitter threshold of transistor 42 is forward biased during transient 86, causing collector-emitter conduction. A negative voltage pulse appears at the collector of transistor 42 corresponding to transient 86. This pulse is inverted by transistor 56 and appears as a positive pulse (with respect to lead 46) at the collector of transistor 56 and provides a positive pulse input (with respect to lead 46) to pulse extender circuit 30. The 555 timer 61 switches LED 74 "ON" upon detection of transient 86 and holds LED 74 "ON" for a nominal 2 seconds to permit visual perception. Subsequently LED 74 is turned "OFF" and remains off as shown by trace portion 88 until another mode is detected, as at time 90.

Calibration of the mode detector is accomplished at the time of manufacture of applying −6 KV to terminals A-A′ and adjusting potentiometer 40 until trigger circuit 28 is just triggered and an output indication of moding is obtained. The mode indicator 32 should indicate a normal condition upon removal of the 6 KV.

The mode detector may be tested at any time by closing ON-OFF switch 41 and then momentarily closing BATTERY TEST switch 50. Mode indicator 32 will turn "ON" for 2 seconds indicating that battery 34 and the remaining circuit of model detector 12 are functioning normally.

The mode detector of FIG. 2 is intended to be packaged as a simple, low cost portable troubleshooting aid for diagnosing magnetron moding in microwave ovens. It may, however, be incorporated into the oven itself, where it has been found desirable to replace the battery with a simple power supply and eliminate both the ON-OFF switch 41 and BATTERY TEST switch 50.

In the instance of incorporating the mode detector into commercial microwave ovens, it has been found desirable to provide a mode indicator 32 which may be used by the oven operator as well as oven service personnel. In such an instance, it is desirable for the mode detector to record the number of modes and retain this information for reading by the oven operator at his convenience. An alternative embodiment, shown in FIG. 4, achieves this objective by utilizing a digital counter to record and display the number of modes detected.

Figure 4:
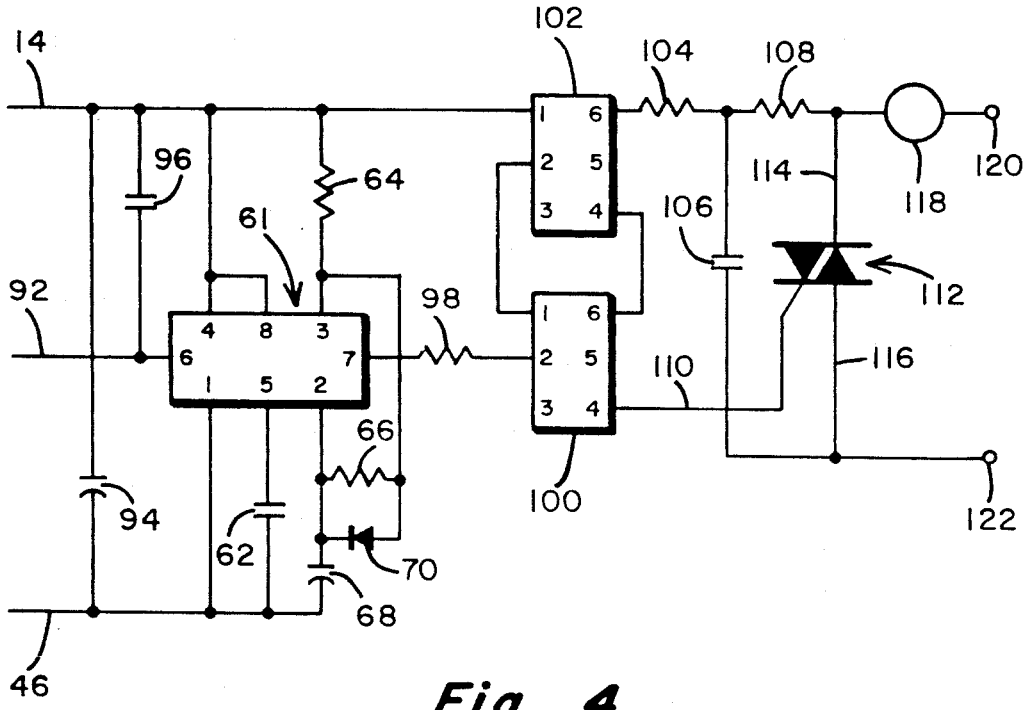
FIG. 4 is a partial schematic showing an alternative embodiment of the mode detector.

Referring now more particularly to FIG. 4, the alternative embodiment of the output portion of the mode detector circuit may be seen. Lead 92 is connected to resistor 60. Timer 61 and its associated circuitry 62–70 is the same as that shown in FIG. 2. A 5 mf capacitor 94 and a 0.1 mf capacitor 96 provide input noise protection for timer 61 and avoid false triggering during start-up. The output of timer 61 is connected through a 300 ohm resistor 98 to an opto-isolator 100, preferably a MOC 3010 type manufactured by Motorola. A second identical opto-isolator 102 is shown connected in series with isolator 100 to provide increased voltage breakdown capability in the output circuit. A gate trigger circuit made up of a 180 ohm resistor 104, a 0.047 mf capacitor 106 and a 1.2 Kohm resistor 108 is connected to the gate lead 110 of triac 112, which is preferably a T25000 type manufactured by RCA. The power leads 114, 116 of triac 112 are connected in series with the input to a digital counter 118 preferably an electromechanical counter suitable for operation from 208 volts AC. Finally terminals 120, 122 are connected to a suitable power supply, preferably 208 volts AC.

In operation, FIG. 4 operates generally similarly to FIG. 2, however in this embodiment timer 61 extends input pulses corresponding to magnetron moding to enable counter 118 to register each as a discrete count. Isolators 100, 102 provide voltage isolation between the mode detector and the output circuit and provide one gate trigger signal on lead 110 for each input pulse received through resistor 98.

The mode detector of FIG. 2 may be used to detect incipient failure of a microwave oven magnetron by connecting the mode detector 12 to an oven magnetron circuit 10 (as shown in FIG. 1) and then energizing circuit 10. In a commercial setting, observation of three or more modes/minute indicates incipient failure and the magnetron tube should be replaced immediately to avoid interruption of the commercial enterprise. An indication of less than three modes per minute indicates the tube still has some useful life.

In a consumer or residential oven application, a higher limit may be set since such an oven typically is used far less than in a commercial application. Hence, for a consumer oven, ten or more modes/minute is an appropriate indication of incipient failure.

In the mode indicator of FIG. 4, the total number of modes is recorded and displayed. This embodiment is intended to be monitored at relatively infrequent intervals until an indication is given that the tube has begun to mode. From then on, the counter 118 is observed at more frequent intervals, for example at the beginning and end of one minute at the start or end of each working day. The difference in readings between the end and the start of the interval divided by the time of the interval will give a discrete output frequency or the rate of magnetron moding.

It is to be understood that the invention is not to be taken as limited to all of the details thereof as modifications and variations thereof may be made without departing from the spirit or scope of the invention.

What is claimed is:

1. Apparatus to detect moding in a microwave oven magnetron comprising:

(a) A voltage divider adapted to be connected to the high voltage anode circuit of a microwave oven magnetron circuit and to provide a low voltage output proportional to transient and steady state conditions of said anode circuit;

(b) a trigger circuit which receives said low voltage output and which provides an electrical output having a pulse-type first output state indicative of the presence of magnetron moding in response to each voltage transient condition substantially exceeding the steady state condition of said anode circuit and a steady second output state indicative of the absence of magnetron moding in response to the steady state condition of said anode circuit;

(c) a pulse extender circuit which receives said trigger circuit electrical output and provides extended electrical output pulses in response to pulse-type occurrences of said first output state; and (d) an electrical to a visually perceptible signal transducer which receives said extended output pulses and which provides a visible indication of the occurrence and frequency of said magnetron moding by visually indicating the occurrence and frequency of voltage transients in said anode circuit.

2. The apparatus of claim 1 wherein said signal transducer comprises a luminous visual indicator.

3. The apparatus of claim 1 wherein said signal transducer comprises a digital counter.

4. A method of detecting incipient failure of a microwave oven magnetron tube comprising the steps of:

(1) Providing a visually perceptible output from a microwave oven magnetron circuit indicative of the presence of magnetron moding and by providing a visible discrete output for each anode voltage transient occurring upon the interruption of anode current, both resulting from magnetron moding;

(2) observing said visible discrete output for an increase in the frequency of said visible discrete output; and (3) determining that an incipient failure exists when said discrete output frequency exceeds a predetermined number of occurrences per unit time of said anode voltage transients.

5. The method of claim 4 wherein the predetermined number for said output frequency is three modes per minute.

6. The method of claim 4 wherein step 2 further comprises observing a digital counter over a known interval and using the ratio of the difference in counter readings to the interval to obtain said discrete output frequency.

* * * * *